United States Patent [19]

Yoshida et al.

[11] 4,062,196

[45] Dec. 13, 1977

[54] METHOD OF FORCIBLY INTRODUCING A CURVED STEEL PIPE INTO THE GROUND AND A MACHINE THEREFOR

[75] Inventors: Hiroshi Yoshida, Chiba; Yoshitaka Kuwabara, Tokyo; Hideo Tsuchida, Yokohama, all of Japan

[73] Assignee: Nishimatsu Construction Company, Ltd., Tokyo, Japan

[21] Appl. No.: 710,854

[22] Filed: Aug. 2, 1976

[51] Int. Cl.[2] ..... F16L 1/02; E21B 7/04

[52] U.S. Cl. ..... 61/72.7; 175/61; 175/73; 175/75

[58] Field of Search ..... 61/72.7, 72.5; 175/75, 175/74, 73, 323, 61

[56] References Cited

U.S. PATENT DOCUMENTS

| | | | |
|---|---|---|---|
| 2,565,794 | 8/1951 | Young | 175/75 X |
| 2,743,082 | 4/1956 | Zublin | 175/75 X |
| 3,132,701 | 5/1964 | Juntunen | 61/72.7 |

*Primary Examiner*—Jacob Shapiro

*Attorney, Agent, or Firm*—Wenderoth, Lind & Ponack

[57] ABSTRACT

A method of forcibly introducing a curved steel pipe into the ground which comprises forcibly introducing into the ground a curved steel pipe in which has been encased an auger train consisting of a plurality of augers coupled in flexible manner with universal joints by jacking said pipe from its rear, rotating said auger train within said curved steel pipe, and conveying away the excavated earth and sand through said pipe, and a curved steel pipe pressing-in machine used in the above method.

3 Claims, 3 Drawing Figures

13a
3
17
4
15
13b
2
16
10
6
12
9
8
7
21
9
1
11
19
18
20
19
22
1
2
7
7
5
5
4

METHOD OF FORCIBLY INTRODUCING A CURVED STEEL PIPE INTO THE GROUND AND A MACHINE THEREFOR

BACKGROUND OF THE INVENTION

This inventin relates to a method of installing a hollow, curved steel pipe in the ground by forcibly introducing a curved steel pipe, and especially a curved steel pipe of relatively small diameter, into the ground at a prescribed angle either from the surface of the ground, or from inside a shaft or tunnel, while excavating and conveying away the earth and sand accumulating inside said pipe with an auger; as well as to a machine that is useful for practicing this method.

The forcible introduction of a straight steel pipe has been frequently practiced in the past, but that of forcibly introducing a curved steel pipe into the ground has not been known. The following methods have been employed in the case of forcibly introducing a straight steel pipe: (1) that of mounting a small shield at the distal end of the straight steep pipe and jacking the steel pipe from its rear end while excavating the earth and sand with the small shield; (2) that of fitting a water-jetting device at the distal part of the straight steep pipe and breaking down and excavating the facing with this jetting device while jacking the straight steel pipe from its rear end; or (3) that of forcibly introducing the straight steel pipe by jacking alone without excavating the facing.

However, in the case of method (1), above, it is not possible to use a shielding machine of a diameter less than 1.5 meters because of mechanical and operational restrictions. Hence, this method cannot be operated in the case of pipes of small diameter. Further, in view of the functions of a shielding machine, this method can scarcely be applied in the case of curved steel pipes whose radius of curvature is less than 50 meters. In the case of method (2), above, the water jet disturbs the ground around the steel pipes, and since the excavation is carried out to excess, difficulty is experienced in introducing the pipe with accuracy by the employment of this method. In addition, this method is objectionable from the standpoint of land subsidence and safety. Furthermore, labor is needed in handling the mud that results from the water jet. On the other hand, in the case of method (3), above, difficulty is experienced in introducing the pipe when the ground condition is hard, with the consequence that when the introduction is forced, the accuracy of the introduction becomes poor. Hence, when this method is applied to a curved steel pipe, it will become still more difficult to expect favorable results.

SUMMARY OF THE INVENTION

An object of this invention is to provide a method by which curved steel pipes can be forcibly introduced into the ground readily and at low cost with accuracy and safety thereby making it possible to construct a structure such as an arched roof inside the ground.

Another object of the invention is to provide a machine to be used for practicing such a method.

We found that the foregoing objects of the invention could be achieved by using a flexible auger train for forcibly introducing the curved steel pipes into the ground, the flexible auger train being one formed by employing the usual type of auger used in excavation inside a straight pipe and coupling a plurality of such augers with universal joints so as to become the desired length. Thus, there is provided in accordance with this invenrtion a method for forcibly introducing a curved steel pipe into the ground which comprises forcibly introducing into the ground a curved steel pipe having an auger train encased therein by jacking the curved steel pipe from its rear end, rotating the auger train inside the pipe, and discharging the excavated earth and sand to the outside via the inside of the steel pipe. In accordance with the above-described invention method, it is possible to forcibly introduce with accuracy and a small force even a curved steel pipe whose diameter is about 200 millimeters and whose radius of curvature is about 5 meters.

There is further provided in accordance with this invention a machine that can be conveniently used for practicing the above-described method. This machine for forcibly introducing a curved steel pipe consists of a supporting framework provided with a guide having the desired radius of curvature, an excavator capable of being moved or secured along the guide, and a jack having a fulcrum coupled to the excavator and a point of reaction force capable of being secured or moved along the guide, the excavator being provided with a motor, an auger detachably coupled to the motor, and a securing member disposed about the auger and adapted to detachably hold the curved steel pipe in conformance with the curvature of the guide.

BRIEF DESCRIPTION OF THE DRAWINGS

This machine will be described by referring to the accompanying drawings, in which.

DETAILED DESCRIPTION OF THE INVENTION

Figure 1:
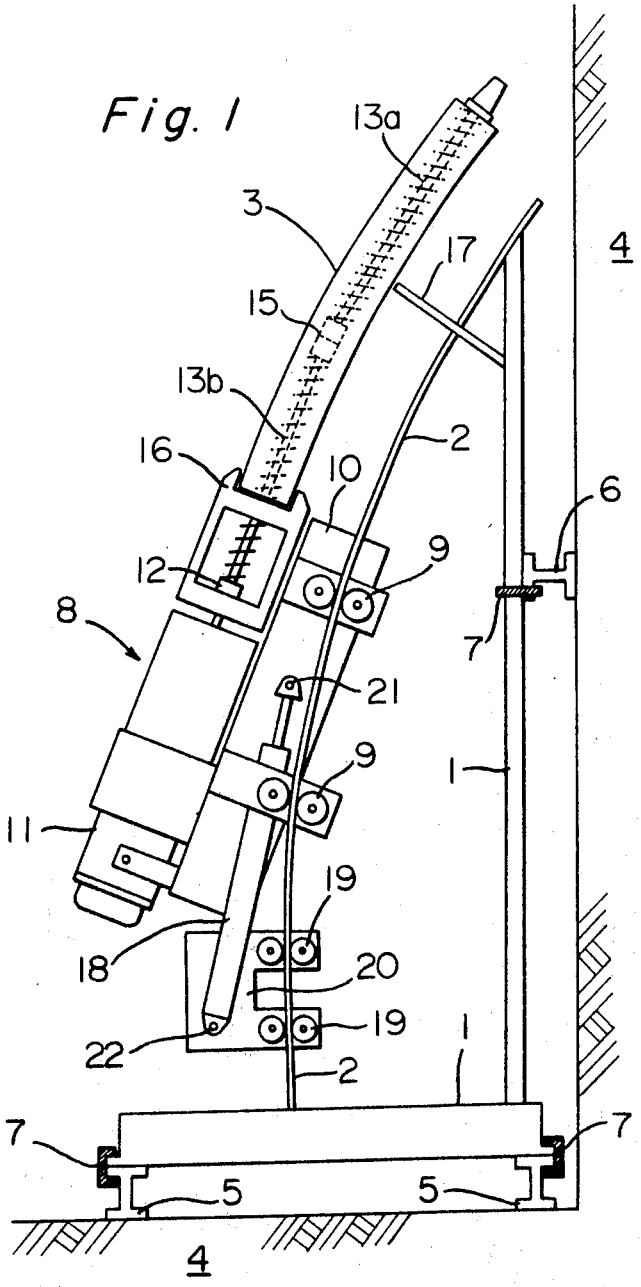
FIG. 1 is a schematic side view of a curved steel pipe pressing-in machine of this invention.

Referring to FIG. 1, a supporting framework 1 is provided with a guide 2 having a curvature similar to that of the steel pipe 3. The supporting framework 1 is secured firmly with clamps 7 to rails 5 provided on the ground 4 and to a waling 6.

The reference numeral 8 is the excavator. The excavator 8 is made up of a carriage 10 provided with wheels 9 and movable along the guide 2, a motor 11 mounted on the carriage 10, and an auger **13*b* coupled in a flexible manner to the shaft of the motor 11 by way of such coupling means as a universal joint 12. In FIG. 1, another auger 13*a* is coupled to the distal end of the auger 13*b* in flexible manner by means of a universal joint 15. Coupling of the augers in this manner is suitably made in accordance with the length of the curved steel pipe 3. There is also provided atop the carriage 10 a securing member 16, which is adapted to hold the basal end of the curved steel pipe 3 that is fitted about the augers 13*a* and 13*b*. Further, for ensuring that this curved steel pipe 3 is held more stably, a pipe guide 17 is provided in the supporting framework extending therefrom to the vicinity of the middle of the steel pipe 3. Wheels 9 of the carriage 10 are provided with a suitable stopper (not shown) by which the carriage 10 can be secured immovably at a desired position along the guide 2, when necessary, as hereinafter indicated. As a stopper, a simple and sturdy one maybe, for example, one wherein a pinhole provided in the guide 2** and a pinhole provided in the carriage are brought into alinement, and a pin is inserted in these holes.

There are also provided on the guide 2 additional wheels 19, which are secured to the guide by means of a stopper (not shown) in the same manner as indicated hereinabove, but which can be released from the restraining action of the stopper when necessary as hereinafter indicated and which move over the guide. A carriage 20 is mounted over these wheels 19. This carriage 20 and the hereinbefore-described carriage 10 are coupled by way of a jack 18, the fulcrum 21 of the jack 18 being disposed on the carriage 10, and the point of reaction force 22 being disposed on the carriage 20.

The construction of an arched roof inside the ground by using the machine of FIG. 1 will be described below.

First, the wheels 19 are held immovable on the guide 2 by the stopper, while the wheels 9 are released from the restraint of the stopper and held in a state wherein they can be moved. When the jack 18 is actuated in this state, the augers 13*a*, 13*b* and the curved steel pipe 3 ascend along the guide 2 in accompaniment with the carriage 10. Now, if the motor is started when the distal end of the auger 13*b* arrives at the vertical ground 4, the forcible introduction of the curved steel pipe 3 into the ground 4 begins as a result of the excavation by the rotation of the augers 13*a*, 13*b* and the pushing force of the jack 18. The excavated earth and sand is conveyed in a customary manner to the rear by means of the spiral disposed about the augers and discharged to the outside.

Next, upon attainment of the maximum lift of the jack 18, the operation of the augers is stopped, and the wheels 9 are secured by means of the stopper so as to render the wheels 9 immovable on the guide 2, while the wheels 19 are released from the restraint of the stopper. The extended jack 18 is then contracted by raising the carriage 20 along the guide 2, at which position the wheels 19 are held in an immovable state on the guide 2 by means of the stopper. Next, the wheels 9 are released from the restraint of the stopper, and the operation of the jack 18 and the augers 13*a*, 13*b* are again started.

When the forcible introduction of one curved steel pipe into the ground 4 has been completed by repititions of the foregoing operation, the carriages 10 and 20 are lowered to their low position on the guide 2 and, after coupling another auger and setting a new curved steel pipe in place, the hereinbefore-described operation is repeated. In this manner, a new curved steel pipe is forcibly introduced successively at the rear end of the already introduced pipe.

Figure 2:
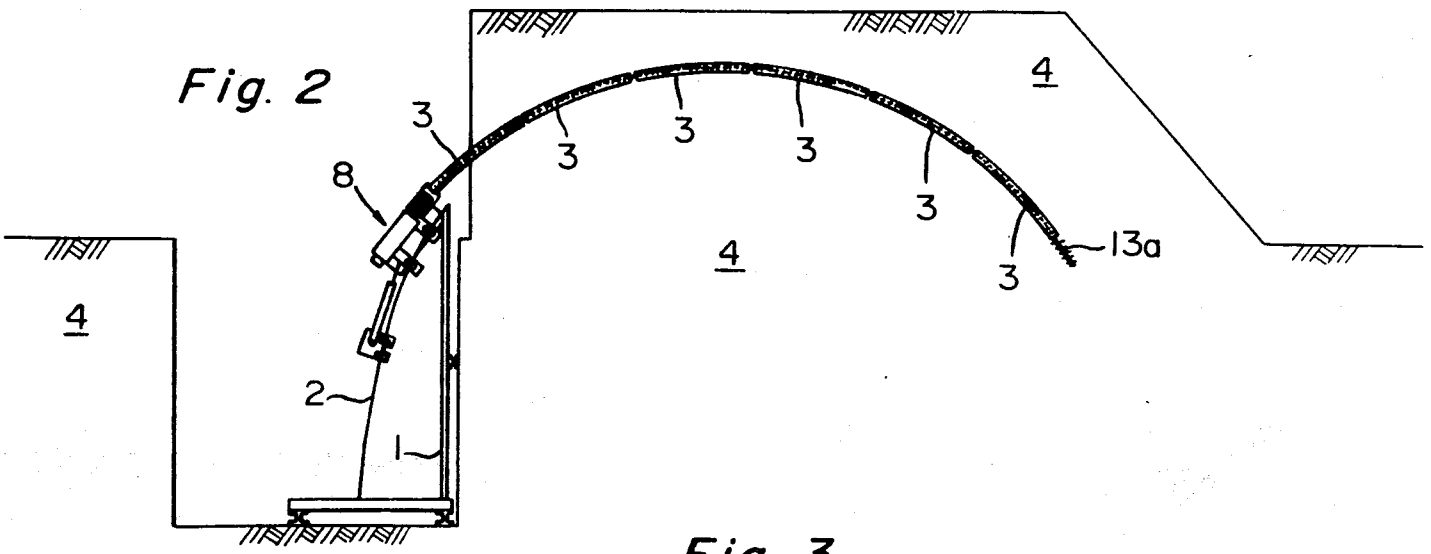
FIG. 2 is a schematic view in longitudinal section illustrating a mode of operation by employment of the machine of the present invention.

FIG. 2 is a sectional view illustrating the state wherein the formation of a steel pipe arch has been completed by successively pressing in the required number of curved steel pipes (six pipes in the case illustrated) by repititions of the operation such as above described. If a plurality of the steel pipe arches such as above described are formed successively alongside each other, it becomes possible to construct the intended arched roof of steel pipes. When curved steel pipes joined to each other with couplings in the circumferential direction are used as in this case, an arched roof not having any gaps between the adjoining curved steel pipes can be made. The curve error $\delta$ at the time of forcibly introducing a curved steel pipe into the ground is as follows:

$$\delta = \frac{R^3}{4IE}(2P + Q\pi)$$

where $\delta$ is the downward curve of the distal end of the pipe,
$R$ is the radius of curvature of the pipe,
$I$ is the moment of inertia,
$E$ is the modulus of elasticity,
$P$ is the earth pressure from the top, and
$Q$ is the pressing force.

It can be seen from this equation that a reduction in the curve error $\delta$ can be achieved by increasing the modulus of section of the pipe and reducing the pressing force. Hence, it is preferred in using the machine of this invention to reduce the required pressing force by causing the cutter at the distal end of the auger to protrude beyond the tip of the curved steel pipe and to cause the excavation to start proceeding at a point in advance of the tip of the pipe. It is, of course, also possible to apply or spray a lubricant to the periphery of pipe as an auxiliary means to reduce the pressing force.

In one construction example in which the invention machine was used, a torque of 280 kg-meter and a pressing force of 10 – 15 tons were required in forming an 11-meter arch using a curved steel pipe having an inside diameter of 257 millimeters, a wall thickness of 12 millimeters, a radius of curvature of 6.9 meters and a length of 1140 millimeters, and augers of outside diameter of 185 millimeters.

Figure 3:
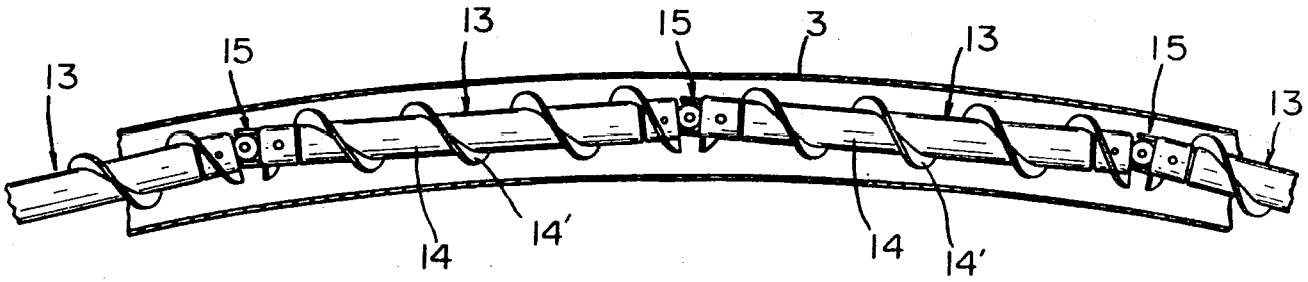
FIG. 3 is a sectional view showing the coupling of the universal joints and augers inside the curved steel pipe.

FIG. 3 is a sectional view showing in detail the state of disposition in series inside the curved steel pipe 3 of a plurality of augers 13 that are coupled by means of universal joints 15. In forcibly introducing the curved steel pipes 3 into the ground, there is a difference depending upon the end to be achieved and the position at which the operation is to be carried out. For example, when the pipe is to be introduced into the ground from a vertical shaft as in the case described hereinbefore, the curved steel pipe 3 is divided into a number of pieces in view of the size of the shaft, and as each piece is introduced, the next piece is introduced after being joined to the previously introduced piece by welding. Therefore, in designing the auger 13 for excavating and conveying away the earth and sand in the curved steel pipe 3, calculations must be made for the pressing force and torque of the auger necessary for performing the excavation and conveyance of the earth and sand, as well as the size of the auger shaft (core pipe) 14, the diameter of the auger vane 14', the numbers of augers 13 and universal joints 15, bending angle and strength on the basis of the minimum clearance and in consideration of the operation conditions. For example, when a curved steel pipe having a caliber of 267.4 millimeters, a wall thickness of 12.7 millimeters, a radius of curvature at the middle of the pipe of 7 meters and a length of 10 meters is to be introduced horizontally into the surface of the ground from a vertical shaft 5.6 × 6.4 meters in size, the diameter of the auger core pipe 14 becomes 101.6 millimeters, the diameter of the auger vane 14' becomes 185 millimeters, the length of each auger becomes 1.0 meter, the numbers of augers 13 and universal joints 15 become 10 while the clearance becomes 6 millimeters.

The method of this invention can be advantageously employed in such cases as where an arched roof is to be formed between two tunnels that are disposed in parallel in the ground by forcibly introducing curved steel pipes in succession from one tunnel to the other. Again, the present invention may also be employed in the construction of a structure for passing gas, water and cables. For example, the invention method can be applied to waterworks tunnel where an abrupt curve occurs in the line.

In the future, it is expected that the range in which the construction of structures utilizing curved steel pipes can be applied will be considerably wide. Since in accordance with the present invention it is possible to carry out accurately the forcible introduction of even the curved steel pipes of small caliber and small radius of curvature with no land subsidence and safety, the present invention makes it possible to use the curved steel pipe even in those areas in which it was hitherto considered impossible to use such pipes. Therefore, the method of this invention can fully meet the wide range of demands that are expected in the future.

We claim:

1. A method for forcibly introducing a curved pipe into the ground comprising:

forcibly jacking said curved pipe into the ground by jacks connected to the rear of said pipe;

rotating a flexible auger train comprised of a plurality of augers coupled together by flexible universal joints within said curved pipe while said pipe is being jacked into the ground; and removing the dirt excavated by said auger train from said pipe.

2. An apparatus for forcibly inserting a curved pipe into the ground comprising:

a support frame;

a guide on said support frame having a radius of curvature corresponding to the radius of curvature of said curved pipe;

movable excavation means slidable and adjustably positioned along said guide for holding said curved pipe and for excavating dirt from the location where said pipe is being inserted, said excavation means comprised of:

a carriage adjustably movable along said guide, stopping means along said carriage for stopping and securing said carriage along said guide, a motor having a shaft mounted on said carriage, flexible auger means coupled to said shaft of said motor, and securing member means surrounding said motor shaft and said auger means for securing said pipe around said auger means; and jack means adjustably positioned along said guide at one end and connected to said excavation means at the other end for forcing said excavation means along said guide.

3. An apparatus as claimed in claim 2 wherein said auger means is connected to said shaft by a flexible universal joint and wherein said auger means is comprised of a plurality of augers and a plurality of flexible universal joints connecting said augers to each other.

* * * * *